US005085539A

United States Patent [19]

Massarsch

[11] Patent Number: 5,085,539

[45] Date of Patent: Feb. 4, 1992

[54] METHOD AND ARRANGEMENT FOR INFLUENCING THE INTERACTION BETWEEN A LAYER OF EARTH AND A STRUCTURE SITUATED IN ASSOCIATION WITH THE LAYER OF EARTH

[75] Inventor: Karl R. Massarsch, Waterloo, Belgium

[73] Assignee: S.A. Compagnie Internationale des Pieux Armes Frankignoui, Belgium

[21] Appl. No.: 466,424

[22] PCT Filed: Sep. 6, 1988

[86] PCT No.: PCT/SE88/00455

§ 371 Date: Mar. 7, 1990

§ 102(e) Date: Mar. 7, 1990

[87] PCT Pub. No.: WO89/02505

PCT Pub. Date: Mar. 23, 1989

[30] Foreign Application Priority Data

Sep. 9, 1987 [SE] Sweden ..... 8703503

[51] Int. Cl.[5] ..... E02D 31/08

[52] U.S. Cl. ..... 405/229; 52/167 R; 405/157; 405/258; 405/267

[58] Field of Search ..... 405/157, 211, 229, 258, 405/267; 52/167

[56] References Cited

U.S. PATENT DOCUMENTS

| | | | |
|---|---|---|---|
| 3,386,251 | 6/1968 | Casagrande et al. | 405/258 |
| 3,804,543 | 4/1974 | Best | 405/258 X |
| 4,279,547 | 7/1981 | Clem | 405/258 |
| 4,647,258 | 3/1987 | Massarsch | 405/258 |

FOREIGN PATENT DOCUMENTS

| | | | |
|---|---|---|---|
| 179028 | 4/1986 | European Pat. Off. | 52/167 |
| 78321 | 4/1987 | Japan | 52/167 |
| 74687 | 12/1943 | Norway . | |
| 445237 | 4/1986 | Sweden . | |
| 566904 | 8/1977 | U.S.S.R. | 405/229 |
| 1136178 | 12/1968 | United Kingdom | 405/229 |

OTHER PUBLICATIONS

Derwent's Abstract No. G 2632B/29, SU 626 154.

*Primary Examiner*—David H. Corbin

*Attorney, Agent, or Firm*—Ware, Fressola, Van Der Sluys & Adolphson

[57] ABSTRACT

The present invention relates to a method and an arrangement for influencing the interaction between a layer of earth and a structure situated in association with the layer of earth. What is characteristic of the invention is that a casing filled with a medium and introduced into a layer of earth is introduced into a material surrounding the casing, which material preferably consists of a bentonite or a bentonite mixture.

19 Claims, 1 Drawing Sheet

METHOD AND ARRANGEMENT FOR INFLUENCING THE INTERACTION BETWEEN A LAYER OF EARTH AND A STRUCTURE SITUATED IN ASSOCIATION WITH THE LAYER OF EARTH

BACKGROUND OF THE INVENTION

The present invention relates to a method and an arrangement for influencing the interaction between a layer of earth and a structure situated in association with the layer of earth. The expression structure is used primarily to denote buildings, tunnels, foundations, devices which produce vibrations and similar. The arrangement, which is in the form of a casing filled with a medium, is intended first and foremost to be arranged close to or in direct association with said structure in a material surrounding the casing.

The arrangement of gas-filled mattresses in earth or water for vibration-damping purposes is previously disclosed. A previously disclosed mattress is the so-called single-cell mattress described in SE-B-8202478-7 (publication No. 430 620). Since this mattress is arranged essentially vertically, and is then filled with a gas, its final geometry in the installed position is not apparent. Mattresses of this kind are frequently forced down to considerable depths, where the surrounding pressure is very high. This makes the mattress difficult to fill with gas, and there is also a risk that it will adopt a pear-shaped cross-section with the narrowest part at the bottom. This form has a negative influence on the vibration-damping characteristics of the mattress. In order to improve the mattress, U.S. Pat. No. 4,647,258 proposes a mattress made of a flexible, multi-layer membrane. In this mattress it is possible to adapt the pressure to the surrounding pressure of the earth at different depths, at the same time as the smaller cells make the mattress less sensitive to puncturing. The mattress is intended to be arranged essentially vertically, with the elongated cells running horizontally. Any vibrations present in the earth which strike the mattress essentially at right-angles or to all intents and purposes at right-angles will be damped effectively. However, the mattress is less well suited to the damping of vibrations in its longitudinal direction. The force-absorbing capacity of the mattress in said direction is likewise restricted.

SUMMARY OF THE INVENTION

The present invention makes available a method and an arrangement for influencing the interaction between a layer of earth and a structure. What is characteristic of the invention is that a shaft is formed in the layer of earth, that said shaft is filled with a material, and that a casing filled with a medium is arranged in said material so that it surrounds the casing. The arrangement is characterized by a casing filled with a medium and introduced into the layer of earth, and by a material surrounding the casing.

The expression influenced interaction between the layer of earth and the structure concerned is used here to denote in the first place the possibility, by means of the method and the arrangement in accordance with the invention, of compensating for or taking up movements in the earth between the earth and the structure. In other words, it is possible by means of the method and the arrangement to achieve movement-equalizing and deformation-equalizing characteristics. Furthermore, the arrangement possesses significant thermal insulation characteristics.

An essential characteristic is that the casing filled with a medium exhibits such flexibility and such resilient characteristics that the volume of the casing reduces as the pressure increases, and increases as the pressure reduces. Previously disclosed single-layer mattresses and previously disclosed multi-layer mattresses can constitute a casing suitable for the intended purpose. These can consist of one or a number of cells filled with a medium in the form of a gas, a liquid, a foam material or similar. Other casings are conceivable, and different examples will be described below.

An essential characteristic feature of the present invention is that the casing is enclosed within a material which shields the casing against contact with the surrounding earth. One of the reasons for the bentonite shield is to form a barrier which is impermeable by liquids, which enables the casing to be arranged close to the surface of the ground. The material in question is preferably bentonite, or a mixture of bentonite with other materials, for example water, sand, cement, asphalt and the like.

The fact that it is possible, by means of the method and arrangement in accordance with the invention, to influence the interaction between the earth and the structure, that is to say the movement-damping and heat-transmitting chracteristics of the earth, means that the invention can be applied in a large number of widely differing areas, some of which are described below in conjunction with the accompanying drawings. The arrangement can thus be used in conjunction with buildings of widely differing kinds, as well as with mechanical structures and railway tracks. The arrangement can also be used in direct association with tunnels or similar structures in order to permit the earth to move to a certain extent in relation to the structure in question.

One of the advantages of the arrangement in accordance with the invention is that it constitutes an active movement damper and/or thermal insulator.

A further advantage of the arrangement in accordance with the invention is that it can be arranged essentially horizontally and is very much suited to the damping of movements in the earth. The design of the arrangement also makes it suitable for the absorption of tractive forces, thereby producing reinforcement of the earth.

Other essential characteristics of the invention are contained in the following Patent Claims.

The invention is now described in greater detail in conjunction with the accompanying drawings, in which:

DETAILED DESCRIPTION OF THE INVENTION

Figure 1:
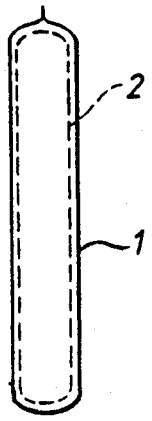
FIGS. 1-3 show a cross-section through preferred embodiments of casings filled with a medium which are a part of the arrangement in accordance with the invention.
Figure 2:
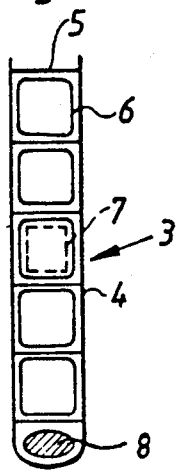

Illustrated in FIG. 1 is a previously disclosed casing 1 of the single-cell type in a layer intended to enclose a medium. Said single-cell casing can also be provided with an inner casing 2 as indicated by broken lines, in order to further improve the strength characteristics of the casing. Illustrated in FIG. 2 is an alternative embodiment of a casing 3 of the multi-cell type. An outer double layer 4 is held together by transverse elements, for example wires, sticks and partition walls or similar. Said elements 5 define spaces for cells 6 filled with a medium. These can consist of one or more layers, as indicated by the designation 7, in one of the cells 6. A weight can be arranged in the lower space 8 for the purpose of retaining the casing in position when this is introduced into a surrounding material, as indicated below. Other types of multi-cell casings are also conceivable within the scope of the invention.

Figure 3:
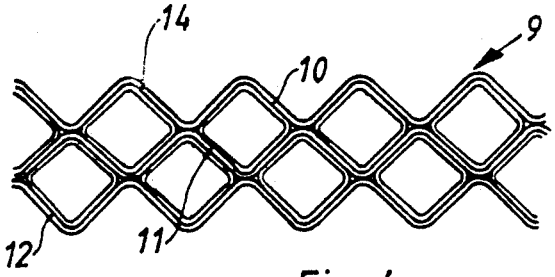
Figure 4:
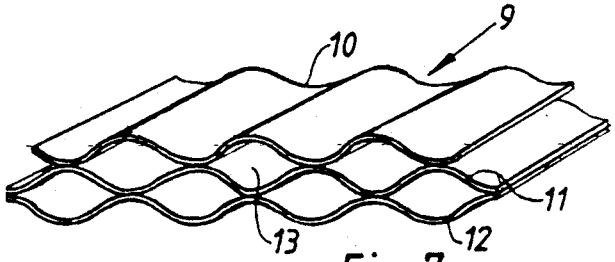
FIG. 4 shows in perspective view a part of the casing in accordance with FIG. 3 without the associated hoses.

Illustrated in FIGS. 3–4 is a further alternative embodiment of a casing 9. The outer casing preferably consists of a woven textile material, a plastic film or a similar fabric material. Three pieces of material 10, 11, 12 are arranged in a flat state and parallel in relation to one another, one above the other. In this way one piece of material 10 forms an upper boundary surface, and one piece of material 12 forms a lower boundary surface for the casing. The piece of material 11 is arranged between the upper piece of material 10 and the lower piece of material 12 and is woven or attached in some other suitable way to these in a zig-zag pattern, so that the interjacent piece of material 11 is attached alternately to the upper piece of material 10 and to the lower piece of material 12. The three pieces of material thus form rows of discrete cellular casings 13, such that two adjacent cellular casings overlap one another to a certain extent viewed in a vertical plane.

In FIG. 3, the casing 9 is shown as a cross section viewed from the front with one cell 14, preferably of the multi-layer type, arranged in each of the individual cellular casings 13. The cell 14 consists preferably of an aluminium foil, which is laminated or in some other way coated on both sides with a layer of plastic film, so that the ends of the cell 14 are capable of being welded together. At the same time this produces a cell 14 which is resistant to corrosion. By arranging protective polyethylene, for example, next to the aluminium foil, the resulting cell 14 is both impact-absorbing and non-diffusing. Every cell 14 preferably exhibits cylindrical form and is made in lengths which correspond to the width of the piece of material and with a diameter which slightly exceeds the diameter of the respective cellular casing. The cells 14 are introduced into the cellular casings 13 either uninflated or only slightly inflated. Because the diameter of the cell 14 is slightly larger than the diameter of the cellular casing, the cell 14 will occupy the whole of the internal space of the cellular casing in the inflated state. A strong overpressure can also be created inside each cell 14 by making the outer piece of material from a strong woven fabric.

The arrangement with overlapping, air-filled cellular casings produces a casing which exhibits a continuous air gap, even when the casing is exposed to very high tensile stresses. Material contact across the casing is effectively prevented, furthermore, due to the continuous nature of the air gap.

As previously mentioned, the arrangement in accordance with the invention can be applied within a number of different areas, and some of these are exemplified below in conjunction with FIGS. 5–11.

The movement-damping and thermal insulation characteristics of the arrangement will be appreciated from the aforementioned Figures.

Figure 5:
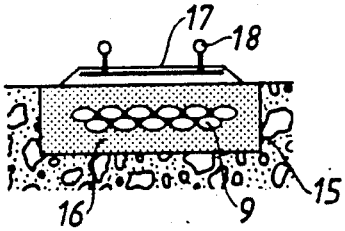
FIGS. 5-11 show different applications of the arrangement in accordance with the invention in conjunction with different structures.

The arrangement in accordance with the invention is applied in the following manner. A piece of the casing having a length appropriate to the intended purpose is filled with a medium, which may be a gas, a liquid, or even a solid substance. A shaft 15 is excavated in the earth, which shaft is conveniently filled continuously during the excavation process with a material, preferably a heavy liquid such as bentonite or mixtures of bentonite, for example. A casing filled with a medium is immersed in the finished, excavated shaft 15, which by now has been filled with the material, so that a column of material is formed between the casing and the surrounding layer of earth. Surplus material equivalent to the volume of the casing filled with the medium is removed in a suitable manner at the same time. Cement, asphalt or some other suitable filling material, for example, is then added to the bentonite in quantities such that the mixture is more or less stabilized. Sand or other similar filling materials can also be added to the mixture. It is, of course, also conceivable from the start to add sand and/or cement to the bentonite. One advantage of filling the space with bentonite or a bentonite mixture is that the whole of the excavated space is filled, and that no air pockets are formed between the casing and the layer of earth. A further advantage is that the bentonite mixture forms a protective layer around the mattress, even if this is introduced very near the surface in a horizontal plane. FIG. 5 shows a casing arranged in a horizontal position in a shaft 15 surrounded by a material, preferably a bentonite-cement mixture 16 in association with a raised bed 17 for a permanent way with the associated rails 18 of the track. The casing is arranged here in direct association with the source of vibration, thus producing an active movement-damping arrangement which very effectively damps the movements in the adjacent layer of earth.

Figure 6:
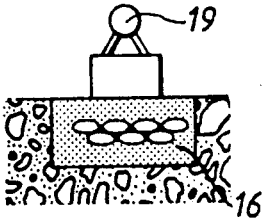

A similar installation is shown in FIG. 6 in association with the foundations 19 for a machine.

In the illustrative embodiments referred to above, and in particular in connection with the casing in accordance with FIGS. 3–4, it is a simple matter in accordance with the invention to make available a casing, the pressure of which is adapted to the dynamic loads acting on the casing. Depending on the diameter of the cells 14 and/or the pressure inside them, it is now possible to adapt the casing to suit structures which are subjected to different dynamic loadings. Due to the presence of the surrounding outer casing, the pressure inside the cells 14 can be made higher than the surrounding pressure of the earth without the risk of puncturing. At the ends of the casing a lateral pressure is maintained via the bentonite-cement filling. It is thus a simple matter to adapt the pressure inside the cells 14 to the prevailing loading, for example, to that from a passing train, in advance, so that the movements are restricted. The result is that a casing is produced, the pressure inside of which is adapted to the dynamic loading acting on the mattress.

Figure 7:
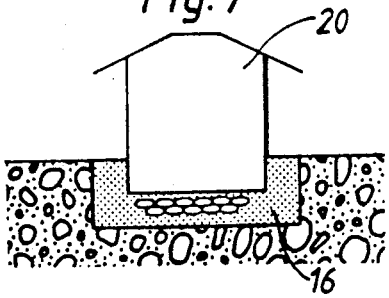

A further field of application is described in conjuction with FIG. 7, which shows a casing arranged directly beneath a building 20 in a material consisting preferably of bentonite or a bentonite mixture. It is possible in this way effectively to damp horizontally propagated oscillations, for example those which result from an earthquake. In association with the struture of houses, the arrangement also influences the heat-transmitting characteristics of the earth.

Figure 8:
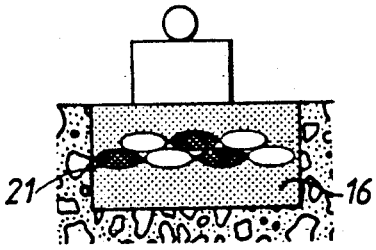

In order further to reinforce the casing it is also conceivable to fill one or more of the cells of the casing with a solid material, for example concrete, as indicated by the designation 21 in FIG. 8.

As previously mentioned, the arrangement in accordance with the invention is sufficiently flexible in the horizontal direction to permit the layers of earth to move in relation to the superjacent structure of the house without the house being subjected to any appreciable degree of vibration. It will thus be appreciated that, by means of the arrangement in accordance with the invention and by means of the casing, the pressure of which inside the various cells can be adapted to the load pressure of a source of vibration, earth materials can be created which exhibit new, controllable dynamic characteristics.

It should be further pointed out in connection with FIG. 7 that it is possible by means of the arrangement in accordance with the invention to create in a simple manner a so-called "light foundation" beneath a building. Previously an attempt was made to solve this problem by the use of so-called compensated foundations, that it to say earth to a weight equivalent to the weight of the building was removed by excavation. The intention was that the subjacent earth would not then feel the load of the building after it had been erected, since this was equivalent to the weight of the earth removed by excavation. The effect of this is that the building can be erected on land with very poor load-bearing capacity. The present invention enables foundations which are in themselves light to be produced, in consequence of which the necessary removal of earth by excavation can be superfluous.

Figure 9:
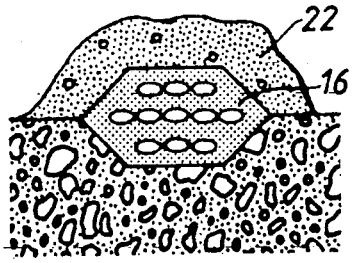
Figure 10:
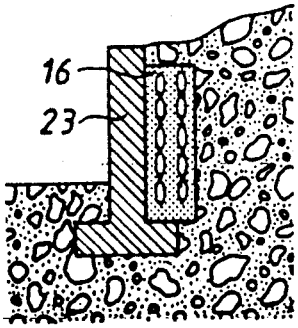

A further area of application which is essential to the invention is the ability to use the arrangement as a filling material in noise barriers 22, for example; see FIG. 9. Present-day noise barriers are costly and require large quantities of filling material. The load imposed by the noise barrier on the subjacent layer of earth is greatest at the central part of the barrier. A lighter filling mass is obtained by arranging one or more casings, preferably gas-filled, at said central part, thereby avoiding the risk of subsidence in the subjacent layer of earth. In the case of supporting walls 23, too (see FIG. 10), where the load acting against the wall is very high, a light filling can be produced by introducing one or more casings into the earth in close association with the supporting wall in a surrounding layer of material.

Figure 11:
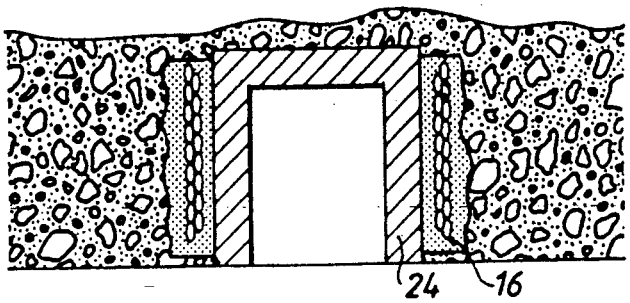

FIG. 11 shows a tunnel 24 arranged beneath the ground. It is a well-known fact that tunnels must be designed and constructed in such a way that they are able to withstand the stresses imposed by the horizontal soil pressure, which pressure increases in proportion to increasing depth. One method is to provide strong reinforcement for the tunnel. By introducing an arrangement in accordance with the invention into the earth, as shown in the Figure, the earth is permitted to move to a certain extent in a direction towards the tunnel, in so doing reducing the pressure of the earth against the walls of the tunnel. With the present invention it is possible, by pre-selecting the pressure inside the cells, to cause the earth in front of the casing to move to a greater or less extent. A flexible layer is created in this way ahead of the tunnel wall, enabling the reinforcement in the tunnel structure to be reduced significantly. A flexible layer of this kind is, of course, also applicable in conjunction with vertical sheet piles and concrete walls, etc. If the casing is to be arranged vertically, it is appropriate to attach one or more weights to it, so that the casing is prevented from "floating up" during the period of stabilization of the bentonite or the bentonite mixture.

It is obvious, therefore, that the method and the arrangement in accordance with the present invention can be applied in a simple manner to influence the interaction between a layer of earth and a structure situated in association with the layer of earth.

Further areas of application are conceivable within the scope of the present invention. The arrangement can thus be applied in soils which are subject to the risk of swelling, for example desert areas which are exposed to large quantities of water, and in soils which are subject to the risk of sinking with the associated risk of damage caused by subsidence.

I claim:

1. Method for influencing the interaction between a layer of earth and a structure situated in association with the layer of earth, comprising the steps of: forming a shaft in the layer of earth in direct association with the structure; filling said shaft with a material; providing a casing filled with a medium; and inserting said casing filled with the medium in said material whereby said material surrounds said casing and said material and said casing together support the structure situated in association with the layer of earth.

2. Method in accordance with claim 1, characterized in that said material filling step takes place at the same time as the shaft forming step.

3. Method in accordance with claim 1, characterized in that said material filling step takes place after the shaft forming step.

4. Arrangement for influencing the interaction between a layer of earth and a structure situated in association with the layer of earth, characterized by means disposed between said structure and said layer of earth for damping vibratory motion transmitted therebetween, said damping means including a casing filled with a medium, said casing being introduced into a cavity in said layer of earth, and a material impermeable to liquids surrounding said casing, said casing and said material together filling said cavity and damping vibratory motion between the structure and the layer of earth.

5. Arrangement in accordance with claim 4, characterized in that the casing and the material are introduced into the layer of earth in close association with said structure.

6. Arrangement in accordance with claim 5, characterized in that the casing comprises at least one cell filled with a medium.

7. Arrangement in accordance with claim 4, characterized in that said cavity is a shaft.

8. Arrangement in accordance with claim 4, characterized in that the casing comprises at least one cell filled with a medium.

9. Arrangement in accordance with claim 8, characterized in that said at least one cell are loosely arranged within said casing.

10. Arrangement in accordance with claim 4, characterized in that the casing comprises a number of cells filled with a medium.

11. Arrangement in accordance with claim 5, characterized in that the casing comprises a number of cells filled with a medium.

12. Arrangement in accordance with claim 11, characterized in that said cells are loosely arranged within said casing.

13. Arrangement in accordance with claim 12, characterized in that said medium is selected from a group consisting of gases, liquids, and solids.

14. Arrangement in accordance with claim 4, characterized in that said medium is selected from a group consisting of gases, liquids, and solids.

15. Arrangement in accordance with claim 4, characterized in that the material surrounding the casing is selected from a group consisting of bentonite and a mixture of bentonite with other materials.

16. Arrangement in accordance with claim 15, characterized in that said other materials are selected from a group consisting of cement, sand, asphalt, and a mixture of cement, sand, and asphalt.

17. Arrangement in accordance with claim 5, characterized in that the material surrounding the casing is selected from a group consisting of bentonite and a mixture of bentonite with other materials.

18. Arrangement in accordance with claim 17, characterized in that said other materials are selected from a group consisting of cement, sand, asphalt, and a mixture of cement, sand, and asphalt.

19. Arrangement for influencing the interaction between a layer of earth and a structure situated in association with the layer of earth, comprising:

a layer of earth having a cavity therein;

a structure situated adjacent to said cavity;

means disposed between said structure and said layer of earth for damping vibratory motion transmitted between said structure and said layer of earth, said damping means including a material impermeable to liquids disposed within said cavity and a casing filled with a medium disposed within said material, said casing and said material together filling said cavity and damping vibratory motion between the structure and the layer of earth.

* * * * *